US005939958A

United States Patent [19]

Grounds, III et al.

[11] Patent Number: 5,939,958

[45] Date of Patent: Aug. 17, 1999

[54] MICROSTRIP DUAL MODE ELLIPTIC FILTER WITH MODAL COUPLING THROUGH PATCH SPACING

[75] Inventors: Preston W. Grounds, III, Davidsonville; Kawthar A. Zaki, Potomac, both of Md.

[73] Assignee: The United States of America as represented by the Secretary of the Navy, Washington, D.C.

[21] Appl. No.: 08/802,473

[22] Filed: Feb. 18, 1997

[51] Int. Cl.[6] ..... H01P 1/203

[52] U.S. Cl. ..... 333/204; 333/995; 505/210

[58] Field of Search ..... 333/204, 205, 333/219, 34, 246, 995

[56] References Cited

U.S. PATENT DOCUMENTS

| | | | |
|---|---|---|---|
| 3,754,198 | 8/1973 | Anghel | 333/204 |
| 3,796,970 | 3/1974 | Snell, Jr. | 333/134 |
| 4,264,881 | 4/1981 | De Ronde | 333/204 X |
| 5,017,897 | 5/1991 | Ooi et al. | 333/204 |
| 5,136,268 | 8/1992 | Fiedziuszko et al. | 333/204 |
| 5,172,084 | 12/1992 | Fiedziuszko et al. | 333/204 |
| 5,192,927 | 3/1993 | Lin | 333/204 |
| 5,534,831 | 7/1996 | Yabuki et al. | 333/219 X |

OTHER PUBLICATIONS

Preston W. Grounds, *Accurate Analysis and Computer Aided Design of Microstrip Dual Mode Resonators and Filters*, 1995, pp. 1–235.

*Primary Examiner*—Seungsook Ham

*Attorney, Agent, or Firm*—Thomas E. McDonnell; Charles J. Stockstill

[57] ABSTRACT

Disclosed is a planar dual mode microstrip filter with the coupling between similar modes on different patches governed by the spacing between the patches rather than by microstrip coupling lines between the patches. The patches are shaped to allow dual mode coupling. The materials used in building this filter were an alumina substrate with gold metalization. The filter is encased in a conducting box made from a conducting material. One advantage of the proximity coupled structure is that it reduces the number of parts, complexity and allows the filter to be realized in a smaller space than in previous dual mode designs. This filter is useful in satellite communications, radar, and cellular communications. High temperature superconductor materials can be used in a planar microstrip form.

15 Claims, 3 Drawing Sheets

MICROSTRIP DUAL MODE ELLIPTIC FILTER WITH MODAL COUPLING THROUGH PATCH SPACING

FIELD OF THE INVENTION

This invention relates generally to microstrip structures, and more particularly to dual mode miaostrip filters which are proximity coupled.

BACKGROUND OF THE INVENTION

Planar microstrip structures are useful in many microwave applications because they are small, light weight, simple to fabricate, and lend themselves to use with high temperature superconductor technology. These applications include satellite communications, cellular phone communications, meteor burst communications, radar, automobile collision avoidance systems, wireless local area networks and general fixed frequency radio communications. Recently, microstrip patch structures have been the focus of much interest due to there use in filters, as patch antennas, and as resonators, all of which are used in the above listed applications.

Planar filters can be built in either single mode or dual mode configurations. In the single mode configuration each metalized patch is a single resonator for the filter. In the dual mode configuration, each dual mode patch acts as two coupled resonators in the filter.

Dual mode elliptic filters are routinely used in satellite communications, where low loss, high Q performance is required. This type of filter is also used in multiplexer applications, since the sharp filter skirts mean that crosstalk between the frequency bands can be kept to a minimum. Due to their high frequency selectivity, dual mode elliptic filters are preferred for both space borne, and ground based applications. These filters have been constructed for microwave applications using several techniques, including cylindrical and rectangular cavities, dielectric resonators in cavities, as well as planar microstrip. Of these, the planar microstrip configuration results in smaller, lighter weight structures than are possible with the other technologies. Compactness and light weight are crucial factors for any filter used on a space platform. The planar structure is also well suited for use with high temperature superconductors, and therefore can be the basis for an extremely low loss filter, with greater power handling capability.

Considerable empirical work has been done with dual mode microstrip patches and coupling between these patches and microstrip lines. Useful elliptic function planar filters have been designed and built, but the lack of analysis has made these filters larger than necessary and has meant that many design iterations were required. Computer simulation allows the construction of dual mode filters with a minimum number of design iterations and tuning steps. Methods for accurate electromagnetic computer simulation useful for efficient filter design are disclosed in the dissertation entitled, *Accurate Analysis and Computer Aided Design of Microstrip Dual Mode Resonators and Filters*, Preston Whitfield Grounds, III, (1995), hereby incorporated by reference.

SUMMARY OF THE INVENTION

It is an object of the present invention to provide a planar microstrip filter structure that is of light weight.

It is an object of the present invention to provide a planar microstrip filter structure which allows the filter to be constructed with fewer parts.

It is an object of the present invention to provide a planar microstrip filter structure which allows the filter to be constructed with smaller dimensions.

It is an object of the present invention to provide a planar microstrip filter structure in which the coupling between similar modes on different patches governed by the spacing between the patches.

It is a further object of the present invention to provide a dual mode miaostrip filter which allows coupling between similar modes on different patches governed by the spacing and shape of the patches rather than by microstrip coupling lines between the patches.

DETAILED DESCRIPTION

Figure 1:
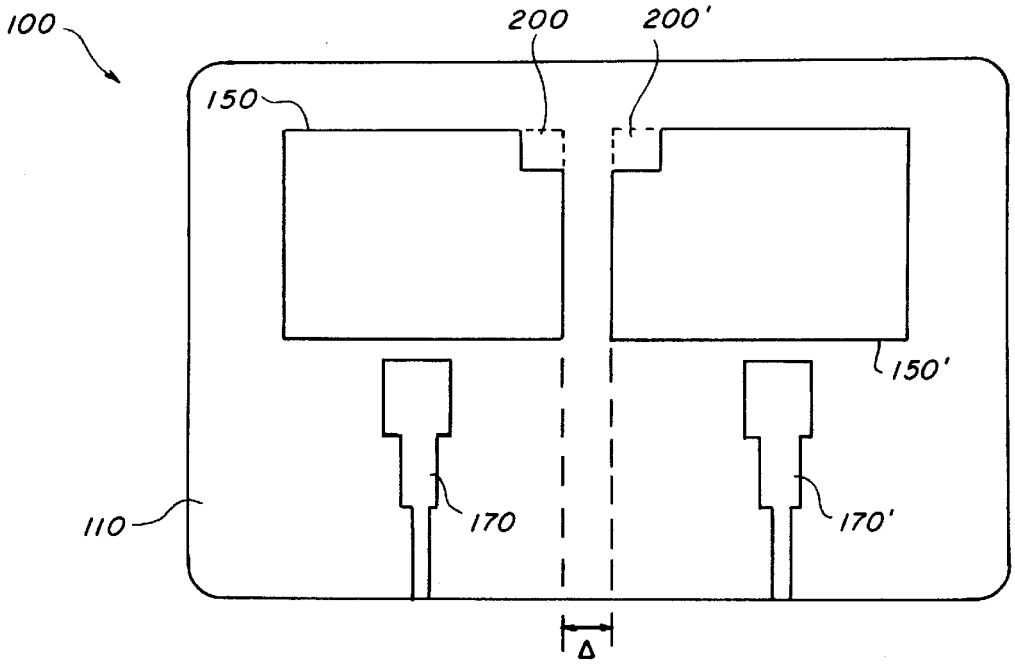
FIG. 1 shows a top view of an elliptical microstrip filter using proximity coupling.

Referring now to the Figures, wherein like reference characters indicate like elements throughout the views, FIG. 1, illustrates the basic structure of the proximity coupled microstrip filter. The proximity coupled (or bridgeless) microstrip filter structure 100 is distinguished from previous microstrip elliptic dual mode filter structures by not employing microstrip lines (or bridges) to couple the modes. The instant invention features a microstrip filter structure in which electromagnetic coupling of the modes is accomplished via the spacing and shape of filter patch 150, rather than through the standard practice of employing microstrip lines to couple the modes.

Figure 2:
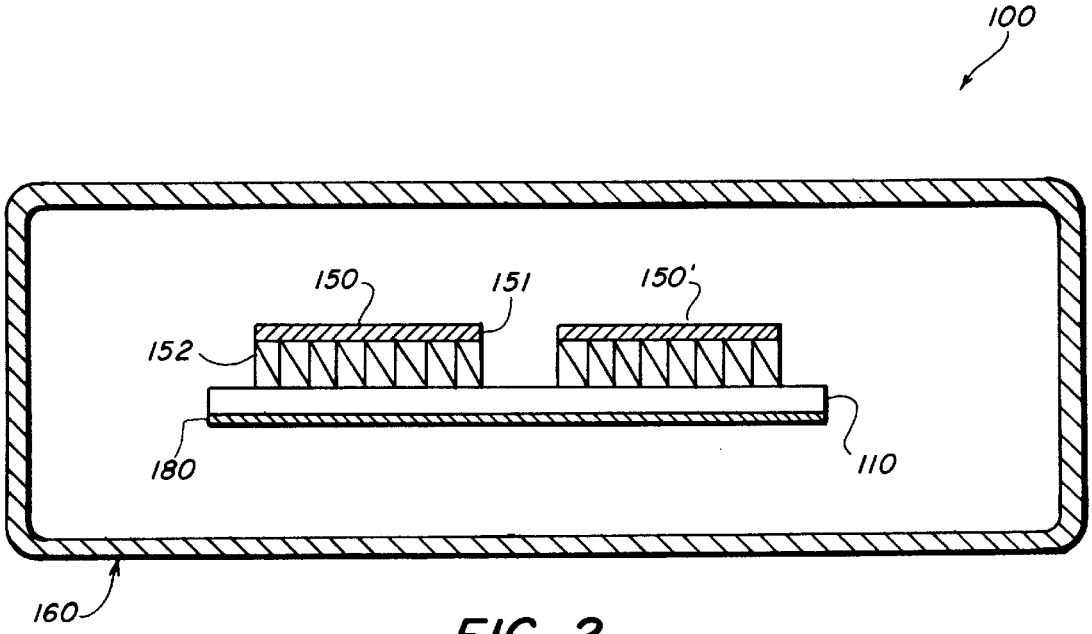
FIG. 2 shows a side view of an elliptical microstrip filter using proximity coupling.

FIGS. 1 and 2 illustrate, a filter which employs a proximity coupling structure. Filter 100 features, a planar structure with two conducting patches 150 disposed on a substrate 110.

Conducting patches 150, 150' are disposed adjacent to each other, each independently coupled to microstrip lines 170,170'. Microstrip lines 170, 170' are disposed parallel to each other, perpendicular to the bottom edge of patches 150, 150' to ensure proper modal coupling. Filter 100 is encased in an enclosure or housing 160 preferably constructed of a conducting material.

In operation a power source (not shown) is coupled to microstrip line 170. Though gap coupling, the current through microstrip line 170 excites a current on the surface of patch 150. The resulting current flow on the surface of patch 150 causes the patch to produce an electromagnetic field. This electromagnetic field couples to patch 150' which excites a current flow on the surface of patch 150'. Patch 150' is gap coupled to microstrip line 170' and an appropriate current flow through microstrip line 170' is produced as a result of the current flow on the surface of patch 150'.

For proper operation of an elliptic filter employing a proximity coupled structure, it is critical that the electromagnetic coupling between all four modes is precisely controlled. Control of the electromagnetic coupling between modes is accomplished by adjusting the space between patches 150, 150' microstrip lines, 170, 170' and the size of corner cutout 200, 200'. The variation in the width of microstrip feed lines 170, 170' are to affect impedance matching between the broad microstrip line coupled to patch 150, 150' and a 50 ohm line.

The filter response may be fine tuned through the use of screws, which may be inserted into the cavity in various lengths at different locations. These screws couple to the fields in the air region of filter 100 and cause the response to change.

Substrate 110 is preferably composed of a material having a high and uniform dielectric constant. Uniformity and high dielectric constant promote a concentrated field between patch 150 and ground plate 180 which improves filter resistance to any electromagnetic fields not excluded by conductive housing 160. The existence of a concentrated field between patch 150 and ground plate allows patch 150, 150' to be physically smaller than required with materials with a smaller dielectric constant. Previous designs using low dielectric constant materials required the patch size to be approximately half the size of the free space wavelength of the center frequency. The high dielectric constant material used in the proximity coupled patch filter allows the patch size to approach one sixth of the free space wavelength, which results in a filter which is physically smaller with a reducedsmass.

Patches 150, 150' are preferably composed of a conductive material with high conductivity. Patch size varies according to the desired frequency response. As patch size increases the filters operating frequency will decrease.

Figure 3:
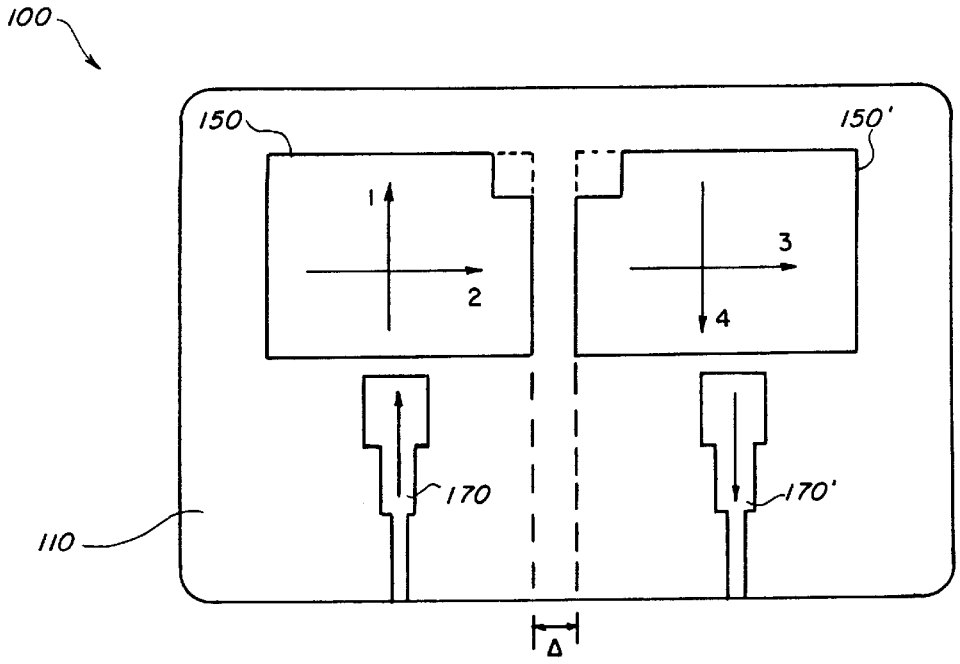
FIG. 3 shows a mode diagram of an elliptical microstrip filter using proximity coupling.

FIG. 3 illustrates a general orientation of the electromagnetic coupling modes of patches 150, 150' and miaostrip lines 170, 170' on dual mode filter 110. Mode 1 and mode 4, both identified on the microstrip feed lines 170, 170', feature a reversed or opposing orientation. It is critical that modes 1 to 4 have a negative coupling, this negative coupling is controlled by the parallel orientation of the microstrip lines 170, 170' as they approach patches 150, 150'.

Referring back to FIG. 1, conducting patches 150, 150' feature a rectangular shape with a corner cutout 200, 200'. Corner cutouts, 200, 200' effect the electromagnetic coupling between the 2 different modes on a single patch. Referring again to FIG. 3, cutout 200, 200' size and location determine the coupling between modes 1 to 2 on patch 150 and modes 3 to 4 on patch 150', respectively.

Coupling between modes located on different patches 150, 150' is governed by the spacing of patches 150, 150' or more specifically to the gap between 150 and 150'. The coupling of modes 2 to 3, and modes 1 to 4 are determined by the gap distance Δ. For a microstrip elliptical filter the coupling of modes 1 to 2, 3 to 4, and 2 to 3 feature positive coupling. Modes 1 to 4 have what is referred to as negative coupling.

Figure 4:
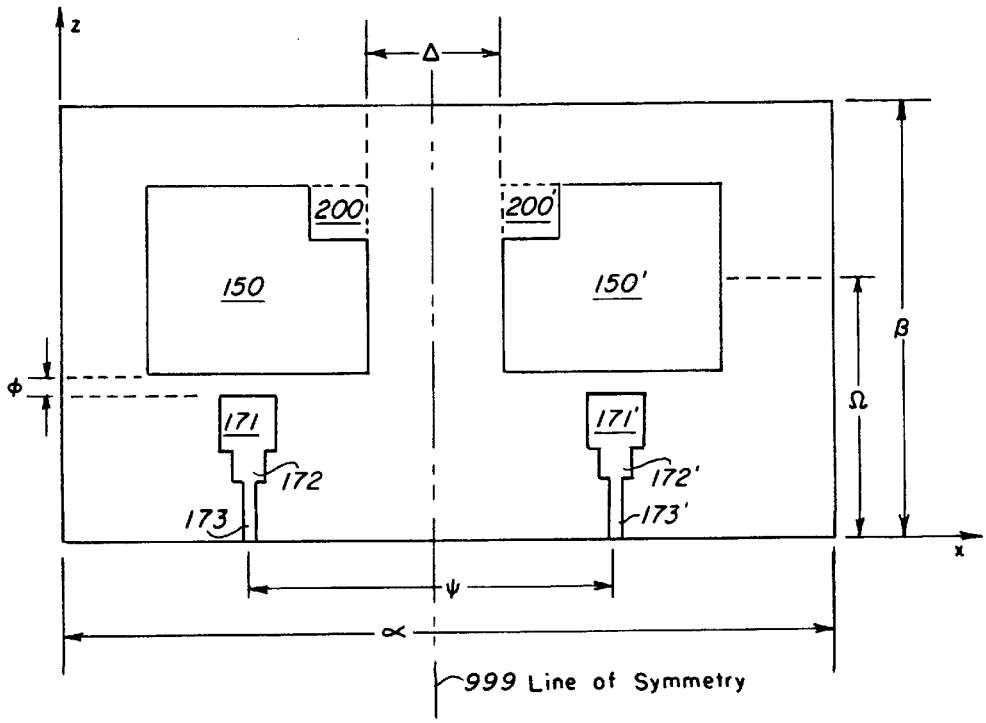
FIG. 4 shows the top view of an elliptical microstrip filter using proximity coupling constructed as a design example.

Referring to FIG. 4, the filter response is given by the scattering parameters. The scattering parameters, $S_{11}$ and $S_{21}$, of filter 110 are determined by employing an even/odd mode analysis. The filter is analyzed in even/odd mode configuration by placing a magnetic/electric wall at the centerline of the filter between the two patches. $S_{11}$ and $S_{21}$ are derived from the reflection coefficients for the electric wall and magnetic wall cases from the following equations:

$$S_{11} = \frac{\Gamma_m + \Gamma_e}{2} \tag{1}$$

$$S_{21} = \frac{\Gamma_m - \Gamma_e}{2} \tag{2}$$

Assume $\Gamma_m$ is the reflection coefficient calculated with a magnetic wall placed at line of symmetry 999, and $\Gamma_e$. is the reflection coefficient calculated with an electric wall placed on line of symmetry 999.

The reflection coefficient is obtained by solving the integral equations relating the currents to the fields (equations 3 and 4).

$$Z_{zz}(k_x,t,k_z)J_z(k_x,k_z)+Z_{zx}(k_x,t,k_z)J_x(k_x,k_z)=E_z(k_x,t,k_z) \tag{3}$$

$$Z_{xz}(k_x,t,k_z)J_z(k_x,k_z)+Z_{xx}(k_x,t,k_z)J_x(k_x,k_z)=E_x(k_x,t,k_z) \tag{4}$$

where t is the thickness of the dielectric layer, and $E_z$ and $E_x$ are the Z and X components of the electric field, respectively.

Equations 3 and 4 are solved using a method of moments technique in the spectral domain with Galerkins procedure. This procedure is known in the art. Equations 5 and 6 result.

$$\begin{aligned}&\sum_{N=1}^{N}\sum_{k_x=-\infty}^{\infty}\sum_{k_z=-\infty}^{\infty} Z_{xz}(k_x, t, k_z)Q_n J_z b_n(k_x, k_z)J_x b_j^*(k_x, k_z) + \\ &\sum_{M=1}^{M}\sum_{k_x=-\infty}^{\infty}\sum_{k_z=-\infty}^{\infty} Z_{xx}(k_x, t, k_z)P_m J_x b_m(k_x, k_z)J_x b_j^*(k_x, k_z) = \\ &\sum_{k_x=-\infty}^{\infty}\sum_{k_z=-\infty}^{\infty} E_x(k_x, t, k_z)J_x b_j^*(k_x, k_z) - \\ &\sum_{k_x=-\infty}^{\infty}\sum_{k_z=-\infty}^{\infty} Z_{xz}(k_x, t, k_z)J_z b_{tw}(k_x, k_z)J_x b_j^*(k_x, k_z)\end{aligned} \tag{5}$$

where j=1 to M.

$$\begin{aligned}&\sum_{N=1}^{N}\sum_{k_x=-\infty}^{\infty}\sum_{k_z=-\infty}^{\infty} Z_{zz}(k_x, t, k_z)Q_n J_z b_n(k_x, k_z)J_z b_i^*(k_x, k_z) + \\ &\sum_{M=1}^{M}\sum_{k_x=-\infty}^{\infty}\sum_{k_z=-\infty}^{\infty} Z_{zz}(k_x, t, k_z)P_m J_x b_m(k_x, k_z)J_z b_i^*(k_x, k_z) = \\ &\sum_{k_x=-\infty}^{\infty}\sum_{k_z=-\infty}^{\infty} E_z(k_x, t, k_z)J_z b_i^*(k_x, k_z) - \\ &\sum_{k_x=-\infty}^{\infty}\sum_{k_z=-\infty}^{\infty} Z_{zz}(k_x, t, k_z)J_z b_{tw}(k_x, k_z)J_z b_i^*(k_x, k_z)\end{aligned} \tag{6}$$

where i=1 to N and $J_z b_{tw}(k_x,k_z)$ is the basis function representing a traveling wave on the microstrip feed line.

$J_z b_m(k_x, k_z)$ and $J_x\ b_n(k_x, k_z)$ are a set of basis functions transformed into the spectral domain representing the currents on the patch, expressed in the x and z directions, where $P_m$ and $Q_n$ are the coefficients of the basis functions which are the unknown quantities to be determined. $Z_{xx}$, $Z_{zz}$ and $Z_{xz}$ are the greens function components.

The layout of the metalization on the substrate is governed by the placement of the currents in equations 5 and 6. The locations of the patch, the cutout, and the feedline, all the dimensions, are set by where the currents are located. By problem definition, where a current is located, metallization is located. By selecting a particular layout of currents, a particular layout of metallization is chosen. The structure is then analyzed for response. An examination of the filter response allows one to choose a new set of dimensions for the patch, cutout, and feedline which will improve the filter response. The filter design is done in this fashion since coding the equations results in an analysis program rather than a synthesis program.

Referring again to FIG. 2 and to FIG. 4 an example of a planar dual mode elliptical filter constructed in accordance with this method is shown. The filter features a substrate 110 constructed of 25 mil thick alumina substrate. The patches 150, 150' feature a top layer with gold metalization 151, 151'. Bonding layer 152 between the gold and the alumina is titanium tungsten. Substrate 110 features a ground plate 180 comprised of some type of conducting material. Housing 160, is constructed of aluminum, and operates to shield filter 100 from electromagnetic radiation thus minimizing radiation losses.

Referring now to FIG. 4 the critical dimension for the example filter are as follows:

| section | Length (z) | width (x) |
|---|---|---|
| 171, 171' | 0.6* | 0.53 |
| 172, 172' | 0.5 | 0.199 |
| 173, 173' | 0.5* | 0.0635 |
| 150, 150' | 0.84 | 0.8669 |
| 200, 200' | 0.074 | 0.074 |
| $\beta$ = 3.213 | $\Omega$ = 2.013 | $\Delta$ = 0.76 |
| $\alpha$ = 4.026 | $\Psi$ = 1.626 | $\Phi$ = 0.00254 |

All dimensions are in cm, *indicate ncritical dimensions. are indicated by *.

Figure 5:
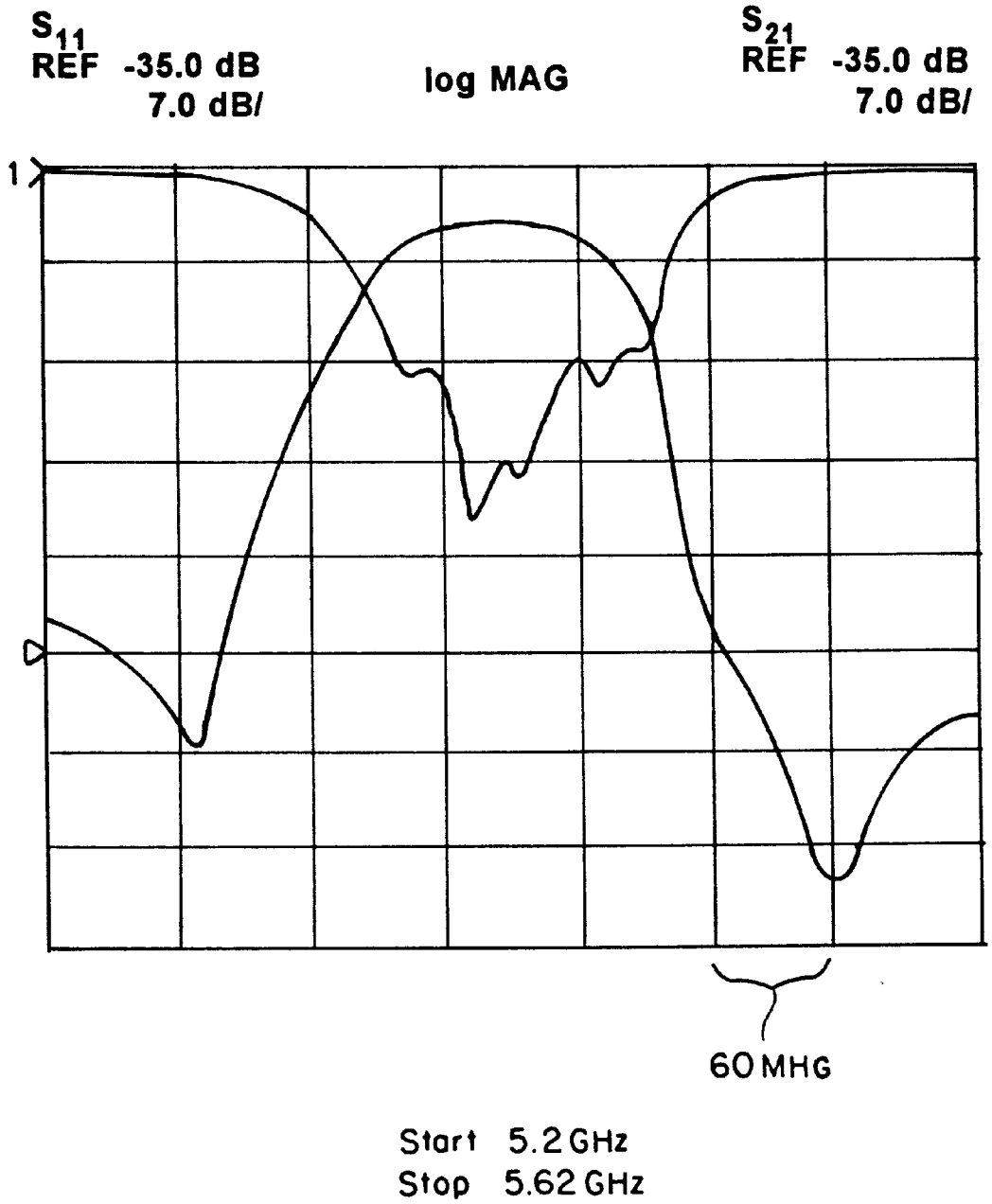
FIG. 5 is a plot of the response of a filter constructed in accordance with the dimensions of FIG. 4 elliptical microstrip filter using proximity coupling.

FIG. 5 is a plot of the measured response of the filter constructed in accordance with above dimensions and the structure illustrated in FIG. 2. Some fine tuning may be required. The roundness in the passband of the filter is due to the loss which is inherent in microstrip lines.

In yet another embodiment high temperature superconductors are used to build dual mode planar filters. Construction of dual mode elliptical filters with proximity coupling from a superconducting material offers some advantages, since microstrip filters typically have a high insertion loss due to resistive losses in the microstrip line and the ground plane. These losses are caused by the induced currents which result from the strong concentrated magnetic fields found near the conductors in the structure. By introducing a superconducting microstrip line and ground plane these losses are substantially reduced. Construction of a filter using proximity coupling in high temperature superconductor form requires the use of a specific dielectric on which the superconductor can be grown. Once that dielectric constant is specified, the appropriate dimensions are defined for building the filter.

This use of superconducting materials in the construction of a filter employing a proximity coupled structure maximizes the efficiency of this filter design and will result in an elliptical filter with a much more pronounced threshold.

Although the embodiments described in the above description feature some type of conductive housing 160, the filter need not be in a conducting enclosure. It may be placed inside a waveguide, shielded microstrip or open microstrip. The losses due to radiation are almost always higher in these cases, but the filter is still operable.

A four pole elliptic filter was used as a design example, however, any type of filter requiring the use of microstrip interconnects can be realized in a more compact form using the planar dual mode patches with proximity coupling. In all applications some analytic work is required to determine the proper filter dimensions.

The materials of substrate 110 and the metalization are not limited to Alumina with gold metalization as discussed in the example embodiment. Any metalization may be used. The dielectric thickness may also be varied. The restrictions are that patches 150, 150' are sized appropriately according to the dielectric type and thickness. Dielectric constant and thickness of substrate 110 can be used as extra degrees of freedom when designing filter 100.

The proximity coupled filter can be fabricated from other types of planar waveguides, including but not limited to, stripline, inverted microstrip, coplanar guide, coplanar strips, suspended microstrip slotlines and finlines among others. Construction of this filter type in stripline configuration is noteworthy, since this configuration will yield the smallest overall package size for the filter.

Obviously, many modifications and variations of the present invention are possible in light of the above teachings. For example this invention may be practiced without the use of a conducting enclosure.

It is therefore understood that, within the scope of the appended claims, the invention may be practiced otherwise than as specifically described.

Applicants claim:

1. A planar dual mode microwave filter comprising:

a substrate, said substrate having a substantially planar form featuring a face;

at least two conducting patches, each of said conducting patches having a predetermined shape and at least two resonant frequencies, said patches being disposed on the face of said substrate using a bridgeless structure such that said patches are electromagnetically coupled to each other, said patch to patch coupling being governed by said patches proximity to each other, and coupling between frequencies of one of said at least two conducting patches being governed by the predetermined shape; and means for coupling said at least two patches to an electrical circuit.

2. A planar dual mode microstrip filter comprising:

a substrate, said substrate having, planar form featuring a face;

at least two metalized patches each having a predetermined shape and at least two resonant frequencies, each of said at least two patches being disposed on the face of said substrate, each of said patches featuring at least one perturbation means disposed on the surface of said patch;

means for coupling said patches to an electrical circuit, means for coupling said at least two metalized patches to each other, said coupling means having a bridgeless structure and forming a gap between said at least two metalized patches, wherein said coupling of the at least two metalized patches is responsive to the gap between said at least two patches, and coupling between modes of one conducting patch of said at least two conducting patches is responsive to the predetermined shape of the one conducting patch.

3. The device of claim 1, wherein said filter is implemented using microstrip.

4. The device of claim 1, wherein said filter is constructed using superconducting material.

5. The device of claim 1, wherein said filter implemented using a finline structure.

6. The device of claim 1, wherein said filter implemented using a stripline structure.

7. The device of claim 4, wherein said filter implemented using a finline structure.

8. The device of claim 4 wherein said filter is implemented using microstrip.

9. The device of claim 1 wherein said filter is implemented using inverted microstrip.

10. The device of claim 9 wherein said filter is implemented using superconducting materials.

11. The device of claim 1, wherein said filter is implemented using a coplanar guide structure.

12. The device of claim 1, wherein said filter is implemented using a suspended microstrip slotline structure.

13. The device of claim 11, wherein said filter is implemented using superconducting materials.

14. The device of claim 12, wherein said suspended microstrip slotline structure is fabricated of superconducting material.

15. A planar dual mode microwave filter, comprising:

a first dual mode conducting patch, having a corresponding cutout portion of a predetermined size; and a second dual mode conducting patch, having a corresponding cutout portion of a predetermined size, electromagnetically coupled to and spaced from the first dual mode conducting patch to form a bridgeless gap of a predetermined size between the first dual mode conducting patch and the second dual mode conducting patch, wherein the electromagnetic coupling between the first and the second dual mode patches is controlled by adjusting the predetermined size of the bridgeless gap, and coupling between modes on a single one of the first and the second dual mode conducting patches is controlled by adjusting the predetermined size of the corresponding cutout portion.

* * * * *